United States Patent [19]

Vandergriff

[11] 4,031,593

[45] June 28, 1977

[54] HOT SHELF SEED COTTON TOWER DRYER APPARATUS AND METHOD

[76] Inventor: Arvel L. Vandergriff, P.O. Box 457, Corcoran, Calif. 93212

[22] Filed: Oct. 7, 1975

[21] Appl. No.: 620,495

[52] U.S. Cl. ..... 19/.27; 19/65 R; 19/66 CC; 34/57 R

[51] Int. Cl.[2] ..... D01G 37/00

[58] Field of Search ..... 19/.27, 203, 66 CC, 19/66 R, 65 R; 34/10, 12, 57 B, 60, 57 R; 432/14

[56] References Cited

UNITED STATES PATENTS

| | | | |
|---|---|---|---|
| 1,899,397 | 2/1933 | Reiche | 34/10 |
| 2,968,874 | 1/1961 | Fishburn | 34/57 R X |
| 3,821,833 | 7/1974 | Wildbolz et al. | 9/66 R |
| R25,460 | 10/1963 | Vandergriff | 19/.27 X |

*Primary Examiner*—Dorsey Newton

*Attorney, Agent, or Firm*—Mason, Fenwick & Lawrence

[57] ABSTRACT

A seed cotton dryer system of the parallel flow tower type, having hollow vertically spaced horizontal shelves alternately extending from opposite sides of the tower to locations near but spaced from the opposite side to define a continuing zig-zag cotton flow path from the top to the bottom of the dryer through which the cotton travels impelled by conveying heated air. The hollow interior chambers of the shelves are supplied with heated air to heat the shelf surfaces and thereby facilitate drying, and the vertical spacing between shelves increases in one or more stages below the uppermost shelves providing for higher shelf velocity over the uppermost shelves. Means for recycling the cotton conveying air through the dryer and for monitoring the dew point of this conveying air to proportionately introduce fresh ambient air into the system and/or for monitoring cotton moisture content and automatically regulating heating of the drying air to regulate moisture content levels may be provided.

28 Claims, 7 Drawing Figures

4
12
56
44
44a
60
62b
58
64b
56
45
60
45a
52a
58
54
46
56
52
46a
60
54a
4
58
47
42
47a
52a
48
54a
48a
64
49
62
40
49a
52a
50
56
60
54a
62a
50a
58
51
64a
51a
30

HOT SHELF SEED COTTON TOWER DRYER APPARATUS AND METHOD

BACKGROUND AND OBJECTS OF THE INVENTION

The present invention relates in general to conditioning of seed cotton for ginning, and specifically for drying of high-moisture seed cotton, and more particularly to seed cotton drying systems involving a tower dryer wherein seed cotton descends along a continuous restricted zigzag path defined by shelflike partitions in a casing forming the tower dryer, with the seed cotton being impelled along the zigzag path by a high-velocity stream of heated air.

Heretofore, the harvesting of high-moisture seed cotton has been recognized as a quality problem as early as the 1930's and much work has been carried on in developing methods of drying the seed cotton prior to ginning the cotton, including work carried on by the U.S. Department of Agriculture Ginning Laboratory at Stoneville, Mississippi. Work by the U.S.D.A. Ginning Laboratory resulted in what has become known as the parallel flow tower dryer, which for many years has been the most prevalent type of seed cotton drying employed at the pre-ginning stage in cotton ginning installation.

Those early efforts were directed at lowering the moisture content of the seed cotton enough to allow the gin to produce a smooth sample. High-moisture seed cotton resulted in rough preparation of the lint. The "preparation" of the lint was a very important quality factor, along with "Grade" and "Staple". More recently, the wide use of lint cleaners which involve a combing action, which are customarily used in gin plants in association with gin stands or between the gin stands and the battery condenser, result in smooth preparation due to the combing action of the lint cleaners under almost all moisture conditions and the "preparation" factor is no longer as significant a factor in quality as it once was.

Prior to World War II, a number of gins were equipped with dryers to improve the preparation, but in those cases, except for the arid areas of Texas and Oklahoma, very little seed cotton cleaning was used in addition to the drying. The labor shortage of the post-World War II period made the careful hand harvesting of seed cotton impractical, and mechanical harvesting of cotton developed at a very rapid rate. This usually resulted in the adding of moisture to improve the efficiency of the seed cotton harvester, resulting in a significant increase in the need for drying at the gin plant prior to the ginning of the seed cotton. Also, the mechanical harvesting method resulted in much more foreign matter being brought to the gin. It was found that drying the lint to a low-moisture content improved the efficiency of the seed cotton cleaning achieved at the gin, and gins across the country rapidly installed two stages of drying and began to use more and more heat energy to produce better grades of cotton notwithstanding the mass of leaf trash and stems in the high-moisture seed cotton resulting from mechanical harvesting methods. In fact, use of three stages of drying in gins to improve seed cotton cleaning is not uncommon today.

The parallel flow tower dryer has become the most commonly and successfully used of the drying apparatus by the ginning industry. The parallel flow tower-dryer method involves the use of direct-fired heaters usually rated at from 3,000 B.T.U. up using natural gas, liquid propane gas or oil, for heating the conveying air designed to impel the seed cotton through the tower dryer. This air for drying and impelling the seed cotton passes through the heater from a suitable blower, picks up the seed cotton to be dried from a rotary airlock under a feeder, and conveys it to the top of the parallel-flow tower dryer. The tower dryer involves a plurality of parallel vertically spaced shelves which alternately extend from one end-wall of a vertically elongated casing to a location near but spaced from the opposite endwall to define a zigzag or labyrinth path descending from the top to the bottom of the tower. The heated air conveys the cotton along the shelves of the tower, dropping it from one shelf to the next and tumbling the seed cotton as it changes directions at the end of the shelf. As the seed cotton reaches the bottom of the tower dryer, the conveying air carries it through a duct to an air-separating unit where the drying air is separated from the cotton and discharged to the atmosphere.

An important factor in the efficiency of the tower-dryer system is the velocity of the air over the shelves, referred to commonly as "shelf velocity". Obviously, the shelf velocity has to be high enough to convey the seed cotton across the shelf and, unfortunately, this required velocity varies with the density of the cotton which is a function of moisture content. The best efficiency is obtained at the lowest shelf velocity which will convey the cotton along the shelves. In the early stages of development of the tower dryer, it was found that about 40 cu. ft. of air per pound of material was optimum. At this ratio, shelf velocities as low as 900 feet per minute were very successful. This resulted in low static pressure losses across the tower and only moderate air temperatures were required.

Of course, such tower-dryer systems were expected to handle only damp cotton, varying in lint moisture from about 8 to 10%. As opposed to this condition, modern high-capacity gin plants are set up to handle maximum moisture contents of from 15 to 20%, although only a small percentage of the cotton being dried has such a high moisture content. This requires shelf velocities in the range of about 3,000 feet per minute to successfully convey the cotton over the shelves at ratios of 25 to 30 cu. ft. of air per pound of material. At these velocities, the cotton is exposed to the drying air for a very short period. To compensate for this short exposure, higher temperatures are used, resulting in excessive consumption of fuel.

An object of the present invention is the provision of a tower dryer system which will reduce energy and fuel consumption and achieve higher efficiency drying of the seed cotton, thereby achieving significant economies in the initial cost of seed cotton drying systems because of reduced horsepower requirements for air-propelling equipment and achieving economies in operation due to greater conservation of heat energy.

As a means of attaining this object, I have devised a parallel flow tower dryer which provides a high-shelf velocity over approximately the upper one-third of the shelves, which will lower the density of the seed cotton material being handled sufficiently to permit a reduced velocity over the next approximately one-third of the shelves. The reduced velocity in this middle approximately one-third of the shelves is accomplished by a wider shelf spacing. The lower approximately one-third of the shelves has a still wider shelf spacing for a still lower velocity, since the seed cotton continues to become less dense as the air absorbs the moisture.

Further, I have attained greater heat conservation and heating efficiency in the system by providing a means for heating the shelf surfaces of the shelves within the dryer, preferably by a separate system of hot air. One innate weakness of the present tower-dryer structure is the rapid cooling of the drying air as it absorbs moisture. When high-moisture cotton is introduced into the drying and conveying air, it is rapidly cooled by evaporation, as well as by radiation losses. Due to the relatively high initial temperature of the air which enters the cotton drying and conveying system upstream of the tower dryer, the moisture transfer is very rapid in the ductwork to the tower and in the upper or first group of shelves of the tower encountered by the heated air, but unless extremely high temperatures are used to pick up the cotton the temperature drop through the system is so great that the moisture transfer in the lower regions of the dryer drops below that necessary to obtain sufficient drying. The alternative is an impractically long system or a second and third stage of drying.

By providing a hot-air chamber internally of each shelf or horizontal divider partition in the tower dryer through which hot air is circulated, the conveying air for the seed cotton passing through the dryer is heated by conduction from the heated shelf surfaces so that a generally uniform temperature can be maintained in the tower from top to bottom. The source of heated air to be supplied to the hot-air chambers provided internally of the shelves can be the same heating source as that used for heating the conveying air or a separate source of heat for the shelves can be provided. By keeping the temperature of the conveying air up to a point which will provide good moisture-transfer rate throughout the tower, the efficiency is greatly improved, and proper efficient moisture transfer can be accomplished by use of such a hot-shelf dryer construction without having excessively high temperatures at the inlet of the tower.

In tower-dryer systems presently in use, it is common practice to separate the drying air from the seed cotton at a temperature in the range of about 150° to 175° F and discharging this separated air to atmosphere. Very rarely is the relative humidity of this air greater than about 10 to 15% which, of course, means that a significant percentage of the heat energy or B.T.U.'s in this air could be saved by recirculating a part of the air.

I therefore propose to improve the efficiency of the system by recirculating a portion of the heated dry air based on maintaining a fixed amount of moisture in the drying air as it is separated from the cotton, so that the drying air may be recirculated until its moisture content reaches a predetermined level.

Thus another object of the present invention is the provision of a novel tower dryer structure for drying seed cotton, wherein the shelves of the tower dryer provide internal chambers which are supplied with heat to heat the shelf surfaces in such manner as to conduct heat from the heated shelf surfaces to the conveying air or reduce heat loss from the conveying air to the shelves to reduce the rate of cooling of the air for heating and conveying the seed cotton and maintain a more uniform temperature from top to bottom of the tower.

Another object of the present invention is the provision of a novel seed cotton tower dryer of the type described in the preceding paragraph, wherein a relatively higher shelf velocity is provided for in the upper portion of the dryer, while a selectively reduced shelf velocity is provided in the mid-portion by increasing the spacing of the shelves, and a still lower shelf velocity is provided in the lower portion by a still wider shelf spacing.

Other objects, advantages and capabilities of the present invention will become apparent from the following detailed description, taken in conjunction with the accompanying drawings illustrating a preferred embodiment of the invention.

DETAILED DESCRIPTION OF A PREFERRED EMBODIMENT

Figure 1:
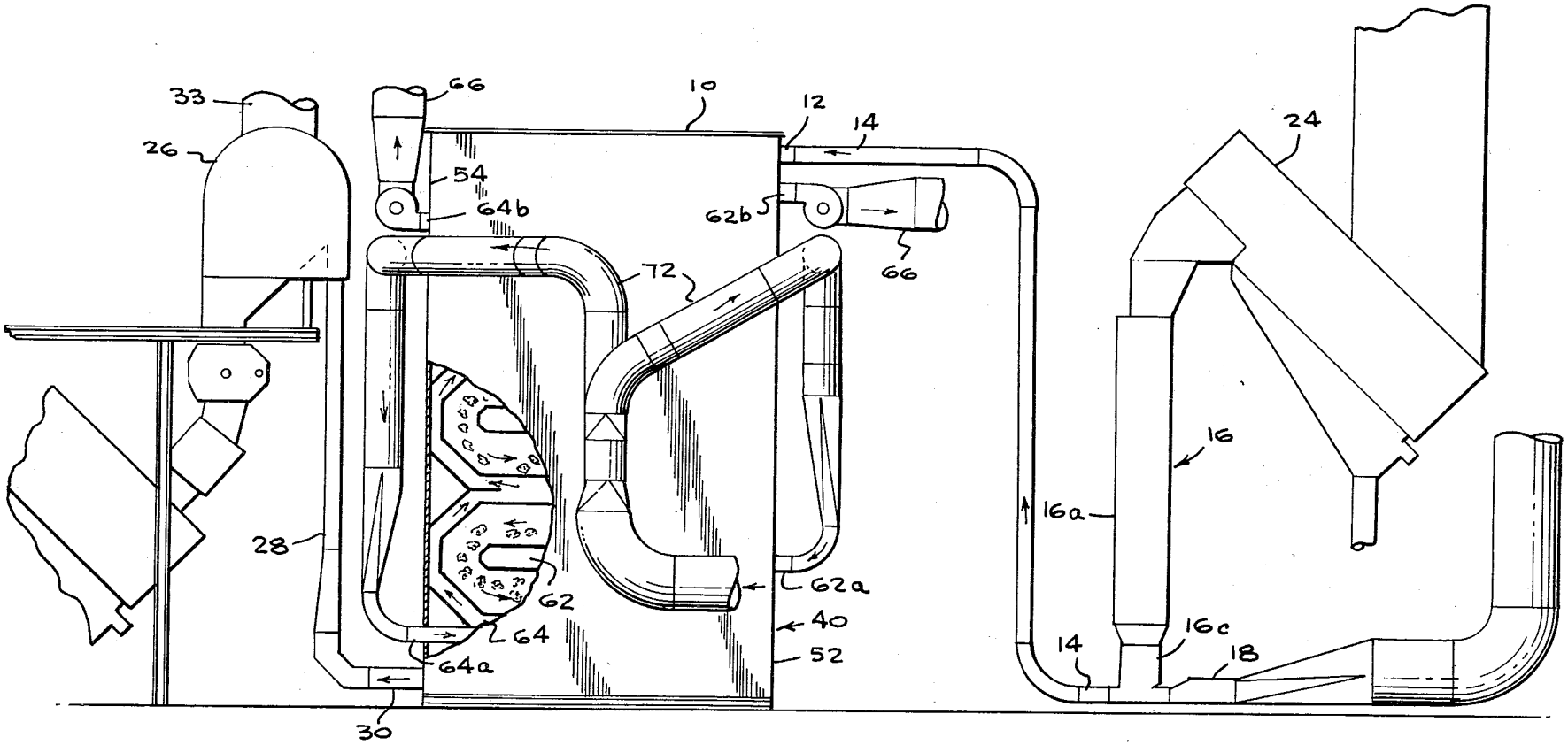
FIG. 1 is a somewhat diagrammatic elevation view of a portion of a seed cotton processing line including the hot shelf tower dryer of the present invention, with parts of the dryer broken away.
Figure 2:
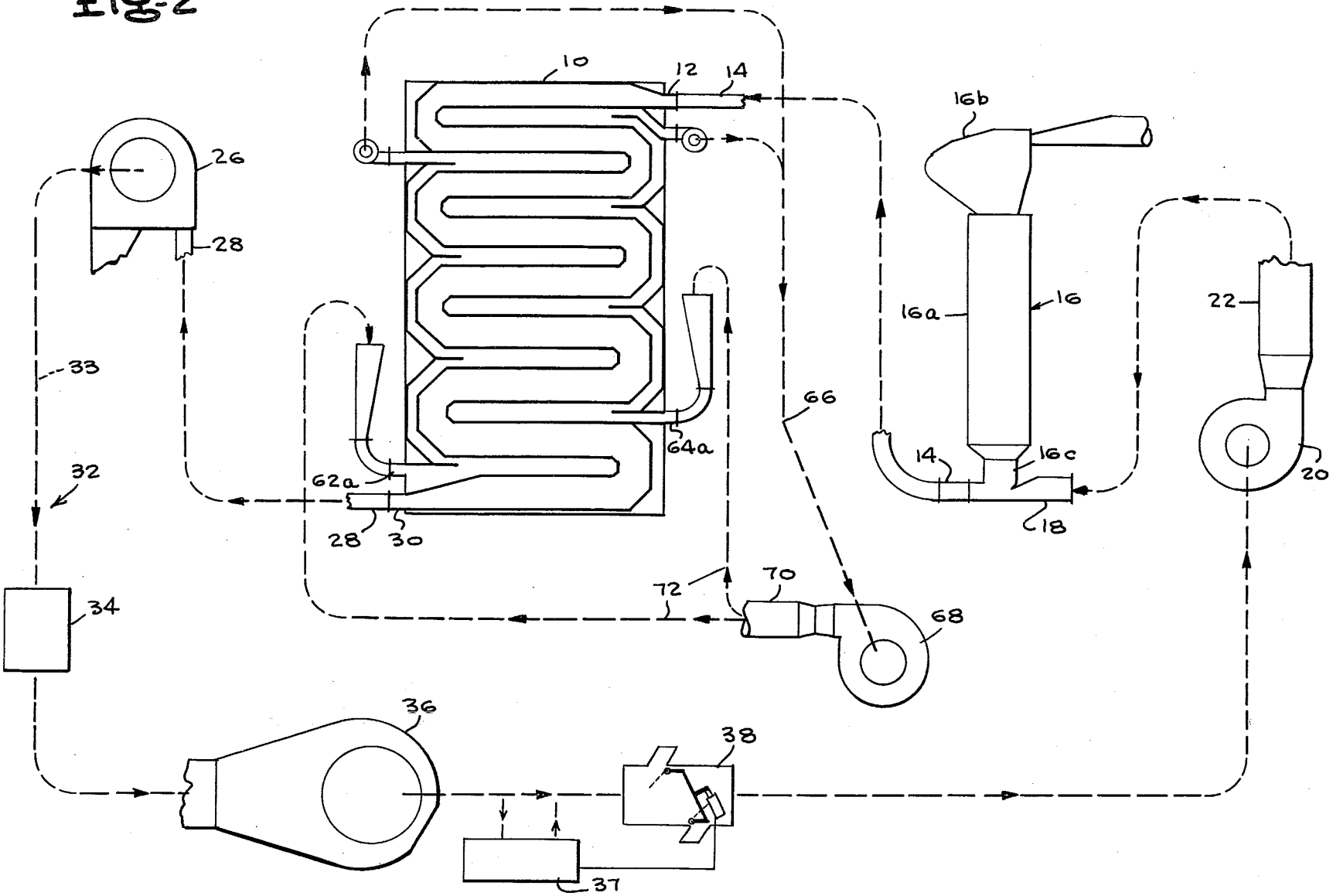
FIG. 2 is a diagrammatic view in flow chart form of the hot shelf tower dryer and principal components associated therewith in a typical installation.

Referring to the drawings, wherein like reference characters designate corresponding parts throughout the several figures, there is illustrated in FIG. 1 somewhat diagrammatically the principal components of a portion of a seed cotton processing line immediately associated with and including a hot shelf tower dryer, indicated by the reference character 10, constructed in accordance with the present invention, and there is illustrated in FIG. 2, in a flow chart type of diagrammatic presentation the basic components associated with the hot shelf dryer 10 for handling the seed cotton and the conveying and drying air, and the shelf heating air, to be later described. Referring to FIG. 1, the hot shelf tower dryer 10 of the present invention is interposed in a seed cotton processing line in a location similar to the conventional parallel flow tower dryer previously discussed, to receive at the cotton inlet 12 of the tower dryer the seed cotton pneumatically conveyed thereto along with the conveying-drying air through pneumatic conveying duct 14 extending from the bottom discharge outlet of the conventional cotton feed control unit 16. The control unit 16 may, for example, be of the type having a vertically elongated large surge bin portion **16*a* to receive cotton from a condenser type cotton-air separator 16*b* at the top of the unit, with variable feed rollers at the bottom of the surge bin delivering the cotton through an air-seal vacuum dropper section 16*c* into a pneumatic conveying air stream of heated air supplied to the upstream end of the conveyor duct portion 14 through an air supply duct section 18 from a push fan 20 and associated heater unit 22. The feed control unit 16 may receive pneumatically conveyed cotton at the separator portion 16***b* thereof from any conventional upstream cotton handling equipment, or the cotton-air separator condenser section 16*b* may be dispensed with and the upper end of the feed control 16 receive the seed cotton directly from the discharge of an inclined impact cleaner of conventional construction, indicated at 24 in FIG. 1, for example of the inclined revolving screen type which removes sticks, leaves and hull particles, motes and other trash from the seed cotton delivered to the impact cleaner, for example, by an unloader separator or other conventional equipment.

The processing line portions downstream of the hot shelf tower dryer 10 of the present invention may include, in a typical installation, a conventional revolving screen separator 26 connected by a pneumatic cotton conveyor duct 28 to the cotton and conveying-heating air outlet 30 of the tower dryer 10, the separator acting in a conventional manner to separate the seed cotton received from the tower dryer from the conveying air and discharge it through an associated vacuum dropper section to further cotton processing equipment, while the conveying-heating air which has lost a portion of its heat energy is, in the preferred example, recycled to the push fan 20 by a return pneumatic system, indicated generally by the reference character 32, which may comprise a return air duct 33 connected between the separator and a moist air pull fan 34 for withdrawing the air from the separator 26 and propelling it through an air filter 36 and, if desired, a controlled fresh air intake valve unit 38 where selected proportions of fresh air are drawn into the return system 32 and added to the air being recycled, while related proportions of the air returning from the dryer outlet 30 are discharged from the system.

The hot shelf tower dryer unit 10 of the present invention, in the illustrated embodiment, comprises a vertically elongated casing 40 of generally rectangular boxlike configuration which is relatively high and has a relatively square horizontal cross-sectional profile having a width which may correspond generally to the width of the ducting system 24 supplying the seed cotton to the inlet of the dryer. The casing 40 may comprise side panels 42 and transverse sheet metal panels extending therebetween dividing the interior of the dryer into a plurality of vertically spaced and horizontally extending hollow shelf formations 44, 45, 46, 47, 48, 49, 50 and 51 extending alternately from the front side or front end 52 and the rear side or end 54 of the dryer. As shown generally in FIG. 2, and more clearly in FIG. 3, the shelves 44, 46, 48 and 50 extend from the front end 52 or left-hand end as viewed in FIG. 3 of the casing and terminate short of the right-hand or rear end 54, while the shelves 45, 47, 49 and 51 extend from the rear or right-hand end 54 of the casing and terminate short of the left-hand end. The spaces between the free ends of the shelves and the adjacent end of the casing is in each instance approximately equal to the spacing between the confronting surfaces of the adjacent shelves so that there is thus formed a continuous restricted zig-zag or labyrinth passage from top to bottom of the casing between the cotton inlet 12 and the cotton outlet 30 with a reversal of direction at the free end or delivery end of each shelf.

Figure 3:
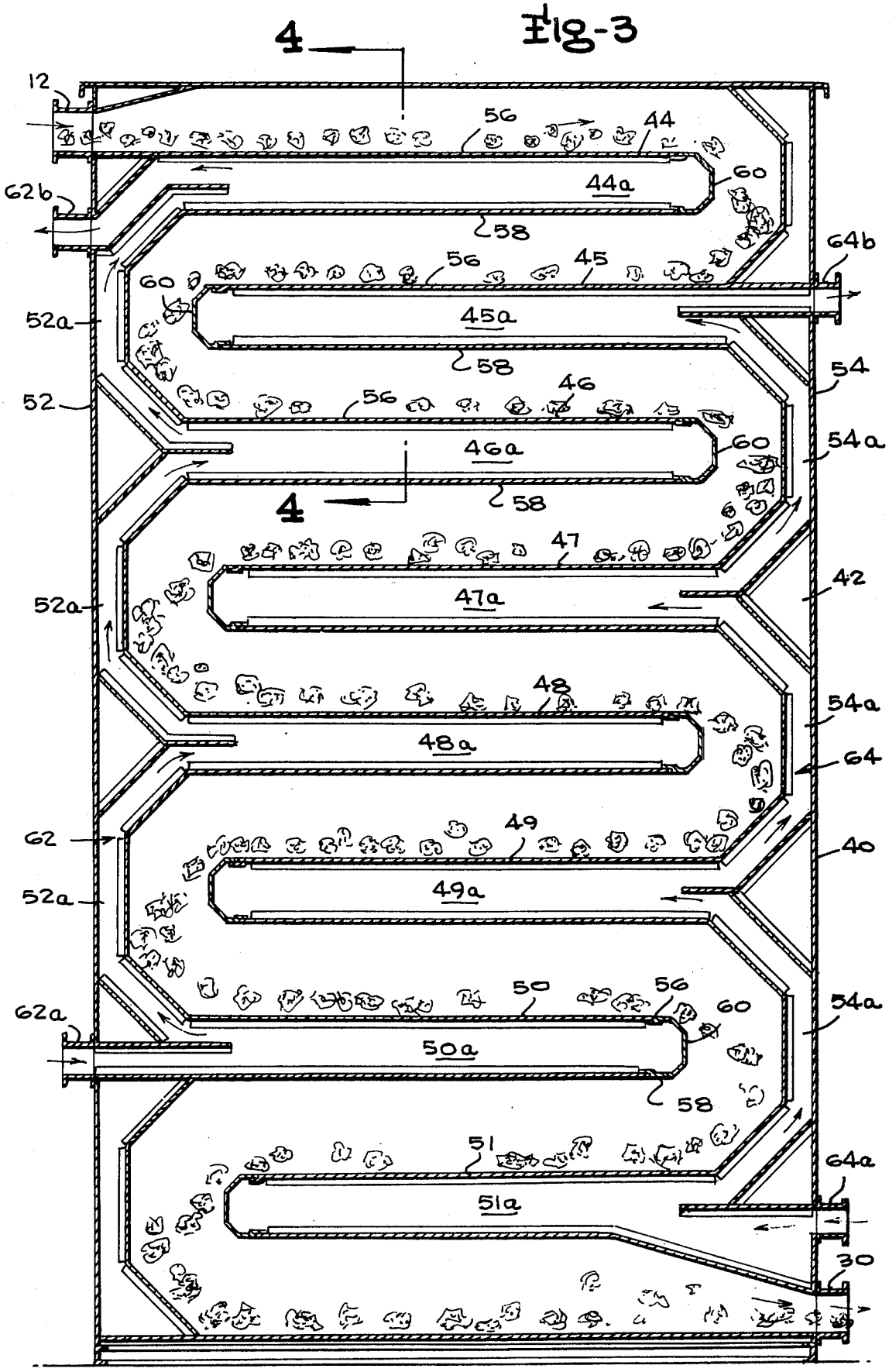
FIG. 3 is an enlarged vertical longitudinal section view through the tower dryer.

As is shown in the drawings, the shelves 44–51 are each formed as hollow sheet metal shelves by providing each with an upper sheet metal shelf panel 56 transversely spanning the dryer between the side panels 42 and defining the upwardly facing or cotton supporting surface of the associated shelf and a lower sheet metal shelf panel 58 defining the lower or downwardly facing surface of the associated shelf and transversely spanning the tower dryer. Each shelf 44–51 is closed at its free end by a sheet metal endwall 60 spanning the width of the dryer, so that the upper and lower panels 56 and 58 and the endwall portions 60 form hollow interiors 44*a*–51*a* for each of the respective shelves 44–51. As illustrated in FIG. 3, the interiors of all of the shelves 44, 46, 48, and 50 are connected at their root ends adjacent the end 52 of the dryer by connecting passage sections 52*a* and are provided with a lower air inlet 62*a* and an upper air outlet 62*b* and form a sealed shelf air heating loop in the tower dryer connecting the interiors of the shelves 44, 46, 48 and 50 as one interior shelf-heating system. Similarly, the interiors 45*a*, 47*a*, 49*a* and 51*a* of the shelves 45, 47, 49 and 51 are connected by passages 54*a* adjacent the end 54 of the dryer, formed by sheet metal panels transversely spanning the dryer and interconnecting the root end portions of those shelves to form a second shelf interior heating loop extending between a lower shelf-heating air inlet 64*a* communicating with the root end of the shelf interior 51*a* and the shelf-heating air outlet 64*b* communicating with the root end of shelf interior 45. As is illustrated diagrammatically in FIG. 2, the upper shelf air outlets 62*b*, 64*b* are connected through an air duct or conduit system 66 to a shelf heat recirculating fan 68 having a heater 70 connected to its discharge end and connected by a branch conduit system 72 to the shelf air inlets 62*a*, 64*a*.

It will be apparent that the circulation of heated air to the shelf interior heating loop 62 defined between the air inlet and outlet 62*a* and 62*b*, and the shelf interior heating loop 64 between the air inlet and outlet 64*a*, 64*b* supplies supplemental interior heating to the shelf surfaces which is higher in the lower zones of the dryer and progressively diminishes as the shelf-heating air cools during its progression from the lower inlet into the higher outlet end of such shelf-heating air loops. This obviously reduces the heat load on the conveying-heating air supplied to the cotton inlet 12 and progressing through the cotton-conveying passages of the dryer and supplies supplemental heating to the cotton and the cotton-conveying air such as to make it possible to maintain a much more uniform temperature from the cotton inlet to the cotton outlet of the drying system.

Furthermore, in order to provide a decreasing velocity in the tower to allow the cotton to travel slower as its density decreases and thus a longer and more thorough exposure of fibres to the heated air from the conveying-heating air supply 20, 22, a variable shelf spacing is provided, whereby the shelves in the upper region, for example, the upper third of the tower dryer are spaced more closely together than the shelves in the mid-region and the shelves in the mid-region are spaced more closely together than the shelves in the bottom third of the dryer. For example, in one exemplary embodiment, the tower dryer may be about 21 feet tall, the spacing between the upper panel 56 and the lower panel 58 of each respective shelf may be about 12 inches, the spacing between the confronting surfaces of the shelves 44 and 45, and the shelves 45 and 46 may be about 15 inches, the spacing between the confronting surfaces of the shelves 46 and 47, and the shelves 47 and 48, and the shelves 48 and 49, may be about 18 inches, and the spacing between the confronting surfaces of the shelves 49 and 50, and the shelves 50 and 51 may be about 21 inches. In this example, the height of the cotton-conveying leg between the upper surface of shelf 44 and the top wall of the dryer may be 15 inches and the spacing between the bottom panel of the bottom shelf 51 and the bottom wall of the dryer may be 21 inches.

It will be apparent that other variations in spacing of the shelves to provide for progressive or periodic increase in the cross-sectional area of the zig-zag cotton passage from the top to the bottom of the dryer may be selected within the ordinary skill of the designer to provide the desired rate of decreasing velocity within the tower, and that shelf spacing may increase a predetermined amount progressing from each shelf to the next from the top to the bottom of the dryer, rather than having the shelves in one portion of the dryer have one selected spacing and a plurality of shelves in each successive section of the dryer progressing downwardly from the top having another uniform selected spacing for each section.

Computations reveal that with such a drying system, using circulating-drying air from the fan 20 and heater 22 such that the air leaving the cotton outlet 30 of the dryer is maintained at about 200° or higher, and using a fan system providing about 24,000 C.F.M. for drying, in a plant operating at about 30 bales per hour, thus providing about 32 cubic feet of air per pound of seed cotton, a range is achieved which will permit minimum shelf velocities for efficient moisture transfer, and the rate of increase of water content of the drying air will be such that even with maximum conditions the volume of air is sufficient to permit a high percentage of recirculated air. Thus to achieve economies in consumption of fuel by the dryer-heater system, the cotton-drying air conveyed through the cotton transfer loop of the dryer between the inlet 12 and outlet 30 is recirculated through the return system 32, including for example the pull fan 34, air filter 36 and fresh air valve 38, with controlled portions of fresh air introduced and moist air discharged at the valve 38 until the drying air reaches a selected moisture level. As one example, the fresh air valve 38 may be controlled by withdrawing a sample of pilot air through a small sampling tube from the return air stream between the air filter 36 and the valve 38 to a sensing unit 37 having a temperature recording probe and a humidity sensing device, such as a Foxboro Dewcel element M 27-01-G having a dew point temperature probe and supplying signals to a controller such as a Foxboro Model 40 Stabilog controller-recorder which supplies output control signals to regulate a pneumatic cylinder positioning the air inlet and the air outlet blades or vanes of the fresh air valve 38. Other conventional humidity sensing and control devices may be employed to automatically regulate the condition of the fresh air valve 38 in any known manner.

The single stage of drying provided by the above-described system is capable of accomplishing the necessary drying for even extreme conditions, and when compared with typical existing systems wherein two and three stages of drying are customarily used, the present system results in significant savings in dryer fuel, and by reducing the drying to a single stage results in a very significant saving in power for air handling.

The common method of controlling the drying or the amount of moisture removal is to control the temperature of the drying air being circulated by the push fan 20 and the heater 22, which may be a direct fired heater of conventional type controlled by a gas valve. In such common drying air controlling system, controlled responsive to the drying air, the controller is usually responsive to the temperature drop in the system at some point downstream in the drying system and provides signals for modulating the gas valve controlling the supply to the heater 22 to maintain a constant temperature at the downstream monitoring point. The optimum moisture content of dried cotton for cleaning is about 5 to 5½ percent. Lower moisture content allows excessive fibre breakage as the fibres are exposed to the action of the cleaning cylinders of conventional cotton cleaning equipment.

Figure 5:
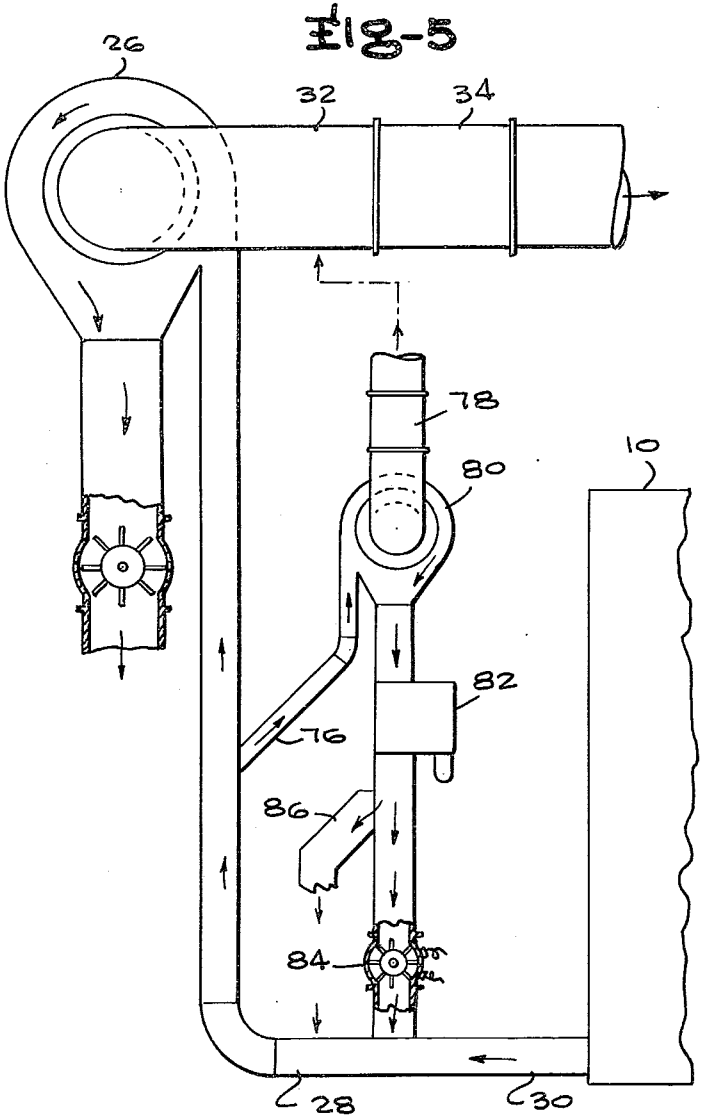
FIG. 5 is a diagrammatic view of the tower dryer associated with a pilot stream monitoring system for monitoring cotton moisture content and controlling the drying air temperature.
Figure 4:
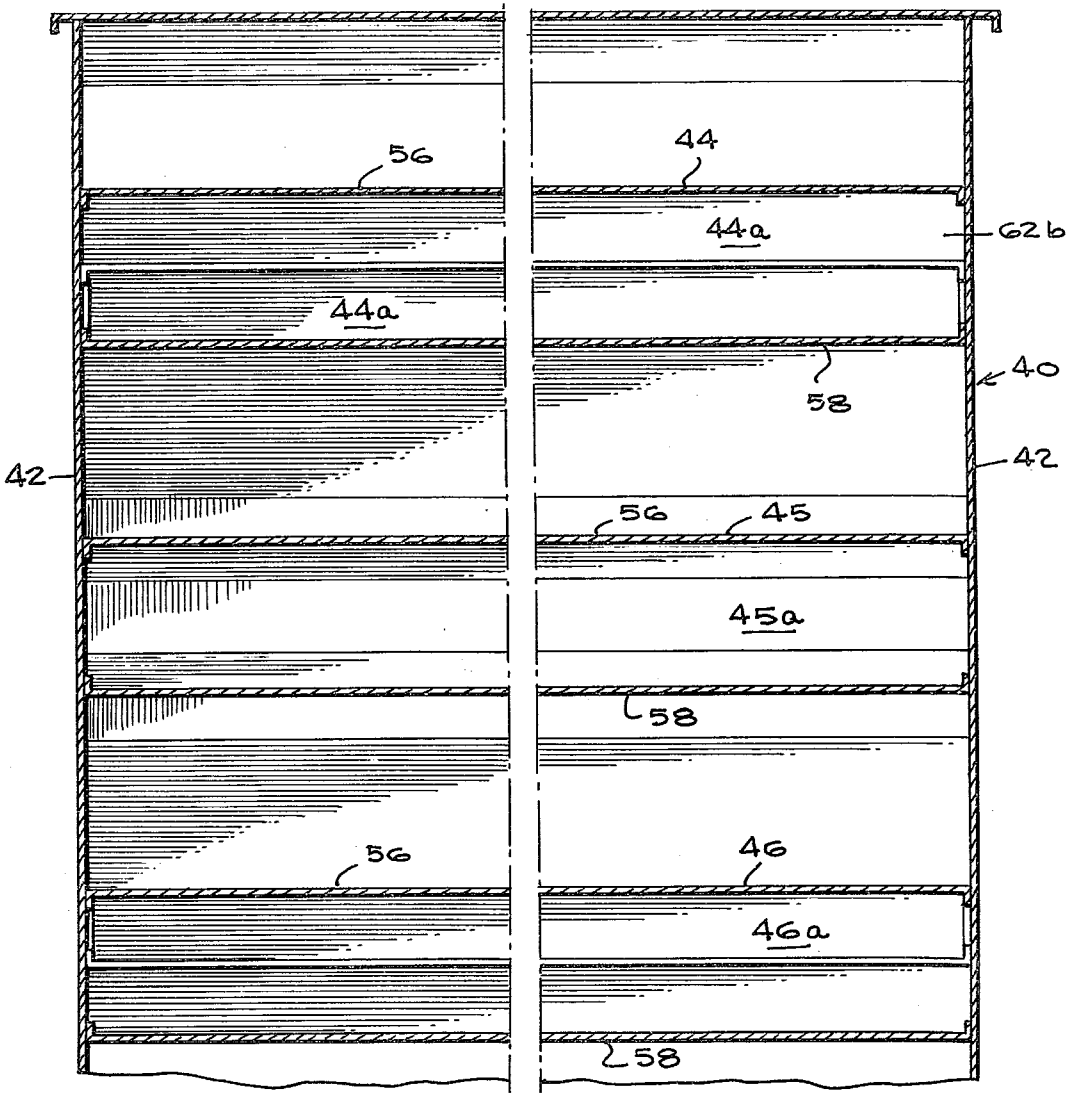
FIG. 4 is a fragmentary vertical transverse section view through the upper portion of the tower dryer, taken along the line 4—4 of FIG. 3.

A more ideal system would be one in which the moisture content of the fibres is sensed at the end of the system and the gas valve controlling the heater 22 for the conveying-heating air or drying air is modulated to maintain the desired moisture content. I have disclosed in FIG. 5 a system which permits the monitoring of the moisture content of the fibres in the seed cotton discharged at the outlet 30 of the hot shelf tower dryer 10 and producing sensible signals for regulating the heating of the drying air discharge from the fan 20. This system deals only with a pilot stream of the dried cotton being removed from the main duct 28 connecting the dryer outlet 30 with the separator 26, by withdrawing the pilot stream of the dried cotton from the duct 28 through a pilot stream branch duct 76 which extracts a pilot sample of dried cotton from the stream in the duct 28 by air at subatmospheric pressure drawn by fan 78 into the pilot stream separator 80. The pilot stream separator 80 is, in the described example, a small rotating separating screen of the condenser type where the conveying air is separated and returned by the fan 78 to the return duct system 32, while the pilot stream cotton sample drops into a small trash separating unit or extractor 82 where the stem and green leaf, which normally would upset electrical resistance measurement of cotton to determine its moisture content, are removed. The cotton feeds by gravity from the extractor 82 into a rotary seal 84 where compressed against two outwardly curving insulated electrically conductive plates spaced apart and located in the scroll portion of the rotary seal around the rotor so that the electrical resistance of the cotton across the plates may be measured. The electrical resistance of the cotton is transmitted to a conventional controller of the type used for modulating the gas valve supplying the drying air heater 22 to modulate this gas valve. Since the electrical resistance of the bat of seed cotton is related to the moisture content of the fibres of the seed cotton in a known relationship, the electrical resistance thus provides an appropriate signal to the controller for modulating the gas valve regulating the drying air heater 22 and/or shelf heating air heater 70 to maintain the desired moisture content. The air which conveys the cotton sample to the pilot stream separator 80 passes through the screen of the separator and then to the fan 78 which creates the subatmospheric pressure for extraction of the sample from the main cotton stream and the air is returned from the fan 78 to the main air current through which air is withdrawn from the main stream separator 26.

A bypass duct may be provided in the pilot stream line between the extractor 82 and the rotary seal 84 to serve to even the flow of cotton to the rotary seal 84 if wide variations of flow are expected in the main duct 28. In this case, the rotor for the rotary seal and electrical resistance measuring unit 84 would rotate slower and have a storage area or surge bin above it to assure a more even flow of cotton over the electrical plates. The excess of the pilot stream in that case may flow through a second rotary seal device and the total of the pilot stream returned by gravity to the main duct 28 carrying the cotton from the tower to the separator 26.

If desired, the reaction time of the control system can be reduced by also taking a pilot stream in a similar manner from the undried cotton, for example, from the duct 14 between the feed control unit 16 or other source of cotton supply and the dryer 10 and feeding it through a similar pilot stream separator, extractor, and rotary seal and electrical resistance measuring unit, and feeding the electrical resistance signal thus derived also into the controller to provide a signal indicating the moisture content of the undried cotton upstream of the tower dryer. The inclusion of the moisture content sensing system for sensing the moisture content and providing electrical signals to the gas valve controller for regulating heating of the drying air provides a system for avoiding most of the problems which result from drying cotton to dangerously low levels which results in excessive fibre breakage in processing.

By the arrangement hereinabove described, a unique system of seed cotton control is provided by which seed cotton may be received at the gin at maximum moisture contents of up to about 20 percent and be efficiently reduced in moisture content in a single dryer stage and single system to the optimum level for trash removal. Cotton which needs little or no drying, as well as that of high moisture content, is protected from dangerously low moisture levels by the control system wherein the moisture is continuously monitored by the pilot stream moisture monitoring branch. Following initial seed cotton cleaning by conventional cleaning machinery, the seed cotton may then be exposed to controlled humidity air where the moisture content is brought back to about 7 percent to 8 percent prior to being exposed to the high stress action of the saws and ribs in the gin in the course of separation of the lint from the seed. This reduces the fibre breakage to a minimum at this stage of the process which has been a major source of fibre damage. The lint is doffed from the gin saws and conveyed to the next processing station by ambient air. This often reduces the moisture content below the optimum 8 percent for protecting the fibres during the high fibre stress of lint cleaning in conventional lint cleaners. To avoid this damaging action, means may also be incorporated in the cotton processing line to apply humid air to the lint bat prior to it entering the lint cleaner, and this can be repeated for any additional stages of lint cleaning. As the lint cotton is then conveyed from the lint cleaning stages to the battery condenser, the conveying air again is usually ambient air and generally reduces the moisture content below the optimum for pressing and for further processing at the textile mill. Again, means may be provided for applying moisture under a controlled system between the lint cleaner and prior to packaging so that the cotton is packaged at the optimum moisture content of about 8 percent.

Figure 6:
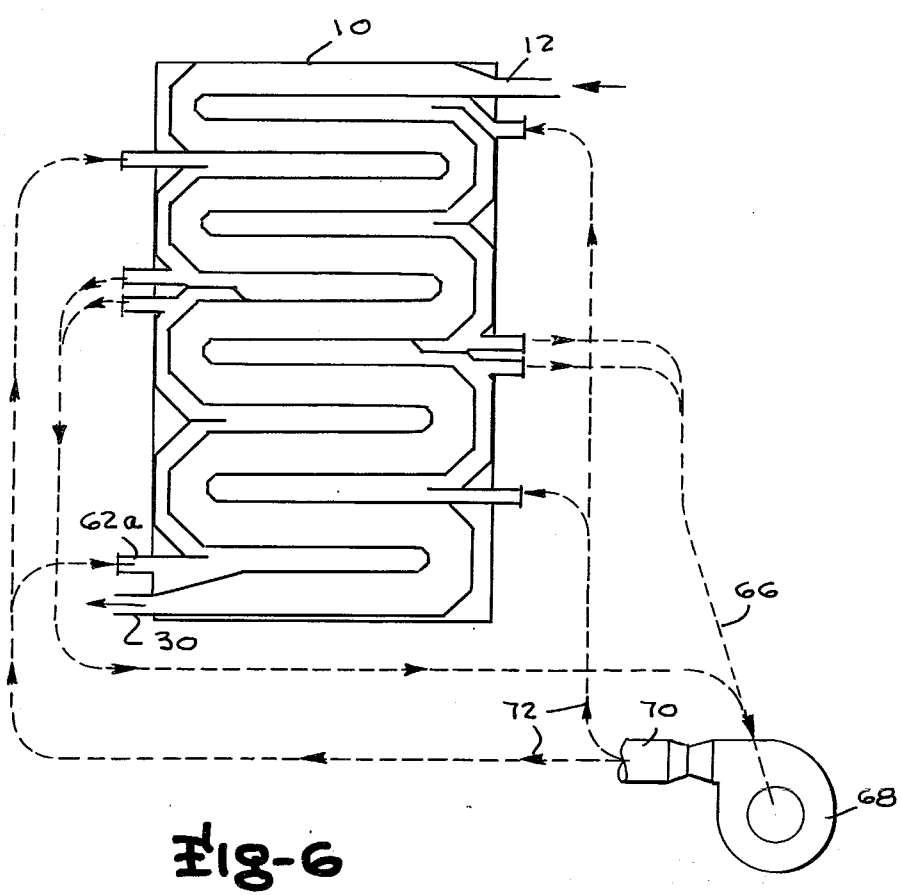

It will be apparent that the above-described seed cotton drying system may be modified by dispensing with the heater 22 so that the drying air flowing through the tower dryer is heated solely by conducting from the heated shelves, in which case the shelves in the upper half of the dryer may form a first shelf-heating-air loop with the heated air introduced at the top and withdrawn at the middle of the dryer, and the shelves in the bottom half of the dryer may form a second loop through which shelf-heating air is circulated from an inlet at the bottom of the dryer to an outlet in the midregion of the dryer, as illustrated in FIG. 6.

Figure 7:
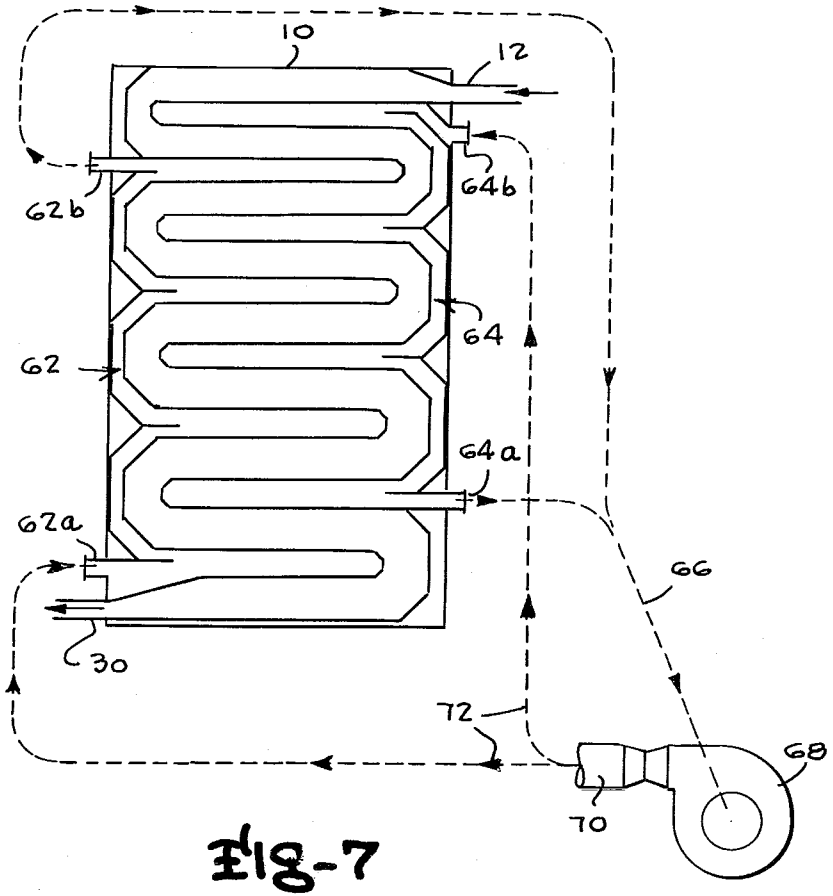
FIGS. 6 and 7 are diagrammatic views in flow chart form of modified forms of the hot shelf tower dryer which may be incorporated in an installation similar to FIG. 2 with or without external heating of the drying air flowing through the tower dryer.

Alternatively, the shelves forming the loop 62 which allow cotton travel in one direction may be heated from hot air entering at the bottom inlet **62*a* and flowing upwardly to the outlet 62*b*, and the shelves in the loop 64 allowing cotton travel in the opposite direction may be heated from air entering at the upper port 64*b* and flowing downwardly to exit through the lower port 64*a*, thus flowing in the opposite direction to the air in the loop 62, as illustrated in FIG. 7.**

What is claimed is:

1. Seed cotton dryer apparatus of the parallel flow tower type for conditioning seed cotton for ginning comprising, a vertically elongated drying tower casing having spaced apart vertical lateral walls and front and rear sides and having an inlet adjacent the top for connection to an air duct through which seed cotton is pneumatically conveyed to receive cotton-conveying heated drying air and cotton conveyed by the drying air and having an air and cotton outlet adjacent the bottom means for heating the drying air, a plurality of vertically spaced horizontal metallic shelves fixed in the casing providing flat horizontal upwardly facing shelf surfaces extending in horizontal planes between said lateral walls and spanning the width of the casing, said shelves from the uppermost to the lowermost commencing alternately from opposite front and rear sides of the casing and each terminating short of the side opposite its commencement thereby defining a continuous restricted zig-zag flow path from the upper end to the lower end of the casing communicating respectively with said inlet and said outlet, the heated drying air and cotton conveyed thereby being admitted to the upper end of said flow path at said inlet to be circulated through said flow path for evaporating moisture from the cotton in the dryer while the drying air impels the cotton along the flow path, and means for supplying heat to said metallic shelves independent of said cotton conveying heated drying air coursing through the drier for heating the surfaces of the shelves substantially throughout their extent to diminish the loss of heat energy from the heated drying air as courses from top to bottom through said flow path and to aid drying of the cotton.

2. Seed cotton drying apparatus as defined in claim 1, wherein the heated drying air coursing through the dryer apparatus is directly exposed to and in close thermal exchange communication with the heated shelf surfaces for heating the drying air conduction therefrom, and the heating supplied to the shelves from the heat source separate from the heated drying air forms a source for heating the drying air.

3. Seed cotton drying apparatus of the parallel flow tower type as defined in claim 1, wherein the drying air coursing through the drying apparatus is directly exposed to and in close thermal exhange communication with the heated shelf surfaces for heating the drying air by conduction therefrom, the apparatus including a first heating source externally of the tower for heating the drying air prior to admission of the heated air to the dryer apparatus, and the heat source for supplying heat to said metallic shelves is separate from said first heating source.

4. Seed cotton dryer apparatus of the parallel flow tower type for conditioning seed cotton for ginning comprising, a vertically elongated drying tower casing having an inlet adjacent the top for cotton-conveying heating drying air and cotton conveyed by the drying air and having an air and cotton outlet adjacent the bottom, a plurality of vertically spaced horizontal metallic shelves fixed in the casing, said shelves from the uppermost to the lowermost commencing alternately from opposite sides of the casing and each terminating short of the side opposite its commencement thereby defining a continuous restricted zig-zag flow path from the upper end to the lower end of the casing communicating respectively with said inlet and said outlet, the heated drying air and cotton conveyed thereby being admitted to the upper end of said flow path at said inlet to be circulated through said flow path for evaporating moisture from the cotton in the dryer while the drying air impels the cotton along the flow path, means including a heat source separate from the heated drying air for supplying heat independent of said heated drying air to said metallic shelves for heating the surfaces of the shelves substantially throughout their extent to diminish the loss of heat energy from the heated drying air as it courses from top to bottom through said flow path and to aid drying of the cotton, means for directly heating the drying air before admission of the drying air to the dryer apparatus, means for separating the drying air from the seed cotton downstream of the outlet from said dryer apparatus and recirculating a variable portion of the heating air back to said inlet to be recycled through said flow path, and means for monitoring the dew point of the drying air separated from the cotton for regulating the amount of drying air recirculated to said inlet.

5. Seed cotton dryer apparatus of the parallel flow tower type as defined in claim 4, wherein the heated drying air coursing through the dryer apparatus is directly exposed to and in close thermal exchange communication with the heated shelf surfaces for heating the drying air by conduction therefrom, and the heating supplied to the shelves from the heat source separate from the heated drying air forms a source for heating the drying air as it passes through the drier.

6. Seed cotton dryer apparatus of the parallel flow tower type for conditioning seed cotton for ginning comprising, a vertically elongated drying tower casing having spaced apart vertical lateral walls and front and rear sides and having an inlet adjacent the top for connection to an air duct through which seed cotton is pneumatically conveyed to receive cotton-conveying heated drying air and cotton conveyed by the drying air and having an air and cotton outlet adjacent the bottom means for heating the drying air, a plurality of vertically spaced horizontal metallic shelves fixed in the casing providing flat horizontal upwardly facing shelf surfaces extending in horizontal planes between said lateral walls and spanning the width of the casing, said shelves from the uppermost to the lowermost commencing alternately from opposite front and rear sides of the casing and each terminating short of the side opposite its commencement thereby defining a continuous restricted zig-zag flow path from the upper end to the lower end of the casing communicating respectively with said inlet and said outlet, the heated drying air and cotton conveyed thereby being admitted to the upper end of said flow path at said inlet to be circulated through said flow path for evaporating moisture from the cotton in the dryer while the drying air impels the cotton along the flow path, and means for supplying heat to said metallic shelves independent of said cotton conveying heated drying air coursing through the drier for heating the surfaces of the shelves substantially throughout their extent to diminish the loss of heat energy from the heated drying air as it courses from top to bottom through said flow path and to aid drying of the cotton, said horizontal metallic shelves each having hollow interiors, and means interconnecting the hollow interiors of said shelves with said means for supplying heat to supply heated air thereto for internally heating the shelves to heat the shelf surfaces and supply heat to the drying air by conduction therefrom.

7. Seed cotton dryer apparatus of the parallel flow tower type for conditioning seed cotton for ginning comprising, a vertically elongated drying tower casing having an inlet adjacent the top for cotton-conveying heated drying air and cotton-conveyed by the drying air and having an air and cotton outlet adjacent the bottom means for heating the drying air, a plurality of vertically spaced horizontal metallic shelves fixed in the casing, said shelves from the uppermost to the lowermost commencing alternately from opposite sides of the casing and each terminating short of the side opposite its commencement thereby defining a continuous restricted zig-zag flow path from the upper end to the lower end of the casing communicating respectively with said inlet and said outlet, the heated drying air and cotton conveyed thereby being admitted to the upper-end of said flow path at said inlet to be circulated through said flow path for evaporating moisture from the cotton in the dryer while the drying air impels the cotton along the flow path, and means for supplying heat to said metallic shelves independent of said cotton conveying heated drying air coursing through the drier for heating the surfaces of the shelves substantially throughout their extent to diminish the loss of heat energy from the heated drying air as it courses from top to bottom through said flow path and to aid drying of the cotton, said horizontal metallic shelves each having hollow interiors, and means interconnecting the hollow interiors of said shelves with said means for supplying heat to supply heated air thereto for internally heating the shelves to heat the shelf surfaces and supply heat to the drying air by conduction therefrom, and a hot air recirculation loop interconnected to the hollow interiors of said shelves for recirculating air from the shelf interiors through a heater and blower and returning the heated air to the shelf interiors to maintain the desired shelf surface temperature.

8. Seed cotton dryer apparatus of the parallel flow tower type for conditioning seed cotton for ginning comprising, a vertically elongated drying tower casing having an inlet adjacent the top for cotton-conveying heated drying air and cotton conveyed by the drying air and having an air and cotton outlet adjacent the bottom, a plurality of vertically spaced horizontal metallic shelves fixed in the casing, said shelves from the uppermost to the lower-most commencing alternately from opposite sides of the casing and each terminating short of the side opposite its commencement thereby defining a continuous restricted zig-zag flow path from the upper end to the lower end of the casing communicating respectively with said inlet and said outlet, the heated drying air and cotton conveyed thereby being admitted to the upper-end of said flow path at said inlet to be circulated through said flow path for evaporating moisture from the cotton in the dryer while the drying air impels the cotton along the flow path, and means including a heat source separate from the heated drying air for supplying heat independent of said heated drying air to said metallic shelves for heating the surfaces of the shelves substantially throughout their extent to diminish the loss of heat energy from the heated drying air as it courses from top to bottom through said flow path and to aid drying of the cotton, said horizontal metallic shelves each having hollow interiors, and means interconnecting the hollow interiors of said shelves with said heat source to supply heated air thereto for internally heating the shelves to heat the shelf surfaces and supply heat to the drying air by conduction therefrom, means for directly heating the drying air before admission of the drying air to the dryer apparatus, means for separating the drying air from the seed cotton downstream of the outlet from said dryer apparatus and recirculating a variable portion of the heating air back to said inlet to be recycled through said flow path, and means for monitoring the dew point of the drying air separated from the cotton for regulating the amount of drying air recirculated to said inlet.

9. Seed cotton dryer apparatus for conditioning seed cotton for ginning comprising, a vertically elongated drying tower casing having an inlet adjacent the top for cotton-conveying heated drying air and cotton conveyed by the drying air and having an air and cotton outlet adjacent the bottom means for heating the drying air, a plurality of vertically spaced horizontal metallic shelves fixed in the casing, said shelves from the uppermost to the lowermost commencing alternately from opposite sides of the casing and each terminating short of the side opposite its commencement thereby defining a continuous restricted zig-zag flow path from the upper end to the lower end of the casing communicating respectively with said inlet and said outlet, the heated drying air and cotton conveyed thereby being admitted to the upper-end of said flow path at said inlet to be circulated through said flow path for evaporating moisture from the cotton in the dryer while the drying air impels the cotton along the flow path, and means for supplying heat to said metallic shelves independent of said cotton conveying heated drying air coursing through the drier for heating the surfaces of the shelves substantially throughout their extent to diminish the loss of heat energy from the heated drying air as it courses from top to bottom through said flow path and to aid drying of the cotton, said horizontal metallic shelves each having hollow interiors, and means interconnecting the hollow interiors of said shelves with said means for supplying heat to supply heated air thereto for internally heating the shelves to heat the shelf surfaces and supply heat to the drying air by conduction therefrom, a plurality of said shelves in an upper portion of the dryer apparatus being spaced apart vertically at a smaller distance than the shelves therebelow to provide a higher heated drying air velocity over the uppermost shelves than over the succeeding shelves along said flow path.

10. Seed cotton dryer apparatus for conditioning seed cotton for ginning comprising, a vertically elongated drying tower casing having an inlet adjacent the top for cotton-conveying heated drying air and cotton conveyed by the drying air and having an air and cotton outlet adjacent the bottom means for heating the drying air, a plurality of vertically spaced horizontal metallic shelves fixed in the casing, said shelves from the uppermost to the lowermost commencing alternately from opposite sides of the casing and each terminating short of the side opposite its commencement thereby defining a continuous restricted zig-zag flow path from the upper end to the lower end of the casing communicating respectively with said inlet and said outlet, the heated drying air and cotton conveyed thereby being admitted to the upper-end of said flow path at said inlet to be circulated through said flow path for evaporating moisture from the cotton in the dryer while the drying air impels the cotton along the flow path, and means for supplying heat to said metallic shelves independent of said cotton conveying heated drying air coursing through the drier for heating the surfaces of the shelves substantially throughout their extent to diminish the loss of heat energy from the heated drying air as it courses from top to bottom through said flow path and to aid drying of the cotton, said horizontal metallic shelves each having hollow interiors, and means interconnecting the hollow interiors of said shelves with said means for supplying heat to supply heated air thereto for internally heating the shelves to heat the shelf surfaces and supply heat to the drying air by conduction therefrom, a plurality of said shelves in the upper approximately one-third of said dryer apparatus being spaced a first relatively smaller distance apart vertically, the shelves in the vertical midregion of the dryer apparatus being spaced a second larger distance apart vertically, and the shelves in the lower third of the dryer apparatus being spaced apart vertically a relatively greater distance than the shelves in either of the other regions to provide a higher shelf velocity for the heating air over the group of shelves in the first region and progressively lower shelf velocities in the midregion and the lower region of the dryer apparatus.

11. Seed cotton dryer apparatus of the parallel flow tower type for conditioning seed cotton for ginning comprising, a vertically elongated drying tower casing having spaced apart vertical lateral walls and front and rear sides and having an inlet adjacent the top for connection to an air duct through which seed cotton is pneumatically conveyed to receive cotton-conveying heated drying air and cotton conveyed by the drying air and an air and cotton outlet adjacent the bottom, means for heating the drying air, a plurality of vertically spaced horizontal metallic shelves fixed in the casing providing flat horizontal upwardly facing shelf surfaces extending in horizontal planes between the lateral walls spanning the width of the casing and having hollow interiors defining an air heating chamber extending throughout each shelf, said shelves from the uppermost to the lowermost commencing alternately from opposite front and rear sides of the casing and each terminating short of the side opposite its commencement, thereby defining a continuous restricted zig-zag flow path from the upper end to the lower end of the casing communicating with said inlet and outlet, the heated drying air and cotton being admitted to the upper end of said path at said inlet, means for circulating the heated drying air through said flow path from said inlet to said outlet to evaporate moisture from the cotton in the dryer and impel the cotton along said flow path, a shelf heating source for supplying heating air to the shelf interiors, and means interconnecting the hollow interiors of said shelves with the shelf heating source of heated air in a shelf heating circuit for internally heating the shelves to diminish loss of heat energy from the heated drying air as it courses from top to bottom through zig-zag path and aid drying of the cotton.

12. Seed cotton dryer apparatus for conditioning seed cotton for ginning comprising, a vertically elongated drying tower casing having an inlet adjacent the top for heated drying air and cotton conveyed by the drying air and an air and cotton outlet adjacent the bottom means for heating the drying air, a plurality of vertically spaced horizontal metallic shelves fixed in the casing having hollow interiors defining an air heating chamber extending throughout each shelf, said shelves from the uppermost to the lowermost commencing alternately from opposite sides of the casing and each terminating short of the side opposite its commencement, thereby defining a continuous restricted zig-zag flow path from the upper end to the lower end of the casing communicating with said inlet and outlet, the heated drying air and cotton being admitted to the upper end of said path at said inlet, means for circulating the heated drying air through said flow path from said inlet to said outlet to evaporate moisture from the cotton in the dryer and impel the cotton along said flow path, and means interconnecting the hollow interiors of said shelves with a source of heated air in a shelf heating circuit for internally heating the shelves to diminish loss of heat energy from the heated drying air as it courses from top to bottom through zig-zag path and aid drying of the cotton, the interiors of the shelves commencing from a first one of said sides being intercoupled in a first air heating loop with the shelf heating source of heated air and the interiors of the shelves commencing from the opposite sides being intercoupled as a second air heating loop with said shelf heating source.

13. Seed cotton dryer apparatus as defined in claim 12, wherein heated air in said first air heating loop enters the casing near the bottom and flows upwardly through the shelf interiors in that loop and heated air in said second air heating loop enters the casing near the top of the casing and flows downwardly through the shelf interiors in the second loop, said casing having an air inlet opening near the bottom for the heated air of said first air heating loop and having an air inlet opening near the top for the heated air of said second air heating loop.

14. Seed cotton dryer apparatus as defined in claim 12, wherein the heated air in both the first and second air heating loops enters the casing near the bottom of the casing and flows upwardly through the shelf interiors forming said loops to outlets for the shelf heating air near the top of the casing, said casing having air inlet openings near the bottom of the casing for the heated air in the first and second air heating loops.

15. Seed cotton dryer apparatus of the parallel flow tower type for conditioning seed cotton for ginning comprising, a vertically elongated drying tower casing having an inlet adjacent the top for heated drying air and cotton conveyed by the drying air and an air and cotton outlet adjacent the bottom, a plurality of vertically spaced horizontal metallic shelves fixed in the casing having hollow interiors defining an air heating chamber extending throughout each shelf, said shelves from the uppermost to the lowermost commencing alternately from opposite sides of the casing and each terminating short of the side opposite its commencement, thereby defining a continuous restricted zig-zag flow path from the upper end to the lower end of the casing communicating with said inlet and outlet, the heated drying air and cotton being admitted to the upper end of said path at said inlet, means for circulating the heated drying air through said flow path from said inlet to said outlet to evaporate moisture from the cotton in the dryer and impel the cotton along said flow path, and means interconnecting the hollow interiors of said shelves with a source of heated air in a shelf heating circuit for internally heating the shelves to diminish loss of heat energy from the heated drying air as it courses from top to bottom through zig-zag path and aid drying of the cotton, means for directly heating the drying air before admission of the drying air to the dryer apparatus, means for separating the drying air from the seed cotton downstream of the outlet from said dryer apparatus and recirculating a variable portion of the heating air back to said inlet to be recycled through said flow path, and means for monitoring the dew point of the drying air separated from the cotton for regulating the amount of drying air recirculated to said inlet.

16. Seed cotton dryer apparatus of the parallel flow tower type for conditioning seed cotton for ginning comprising, a vertically elongated drying tower casing having an inlet adjacent the top for heated drying air and cotton conveyed by the drying air and an air and cotton outlet adjacent the bottom, a plurality of vertically spaced horizontal metallic shelves fixed in the casing having hollow interiors defining an air heating chamber extending throughout each shelf, said shelves from the uppermost to the lowermost commencing alternately from opposite sides of the casing and each terminating short of the side opposite its commencement, thereby defining a continuous restricted zig-zag flow path from the upper end to the lower end of the casing communicating with said inlet and outlet, the heated drying air and cotton being admitted to the upper end of said path to said inlet, means for circulating heated drying air through said flow path from said inlet to said outlet to evaporate moisture from the cotton in the dryer and impel the cotton along said low path, and means interconnecting the hollow interiors of said shelves with a source of heated air in a shelf heating circuit for internally heating the shelves to diminish loss of heat energy from the heated drying air as it courses from top to bottom through zig-zag path and aid drying of the cotton, said apparatus including a hot air recirculation loop interconnected to the hollow interiors of said shelves for recirculating air from the shelf interiors through a heater and blower and returning the heated air to the shelf interiors to maintain the desired shelf surface temperature.

17. Seed cotton dryer apparatus as defined in claim 16, wherein a plurality of said shelves in an upper portion of the dryer apparatus are spaced apart vertically at a smaller distance than the shelves therebelow to provide a higher heated drying air velocity over the uppermost shelves than over the succeeding shelves along said flow path.

18. Seed cotton dryer apparatus as defined in claim 16, wherein a plurality of said shelves in the upper approximately one-third of said dryer apparatus are spaced a first relatively smaller distance apart vertically, the shelves in the vertical midregion of the dryer apparatus are spaced a second larger distance apart vertically, and the shelves in the lower third of the dryer apparatus are spaced apart vertically a relatively greater distance than the shelves in either of the other regions to provide a higher shelf velocity for the heating air over the group of shelves in the first region and progressively lower shelf velocities in the midregion and the lower region of the dryer apparatus.

19. Seed cotton drying apparatus as defined in claim 16, including moisture regulating means including means for processing a portion of the seed cotton being discharged from said cotton outlet to produce signals indicative of the moisture content thereof, and means for varying the heating of the heated drying air responsive to said signals to automatically maintain a predetermined moisture content of the seed cotton being discharged from said outlet.

20. Seed cotton drying apparatus as defined in claim 16, including means for withdrawing a sample of the seed cotton being conveyed from said cotton outlet, separating the withdrawn cotton from conveying air, and forming a seed cotton batt therefrom, means for measuring the electrical resistance properties of the cotton batt to produce signals indicative of the moisture content of the cotton and varying the heating of the heated drying air responsive to said signals to automatically maintain a predetermined moisture content of the seed cotton being discharged from said cotton outlet.

21. Seed cotton drying apparatus for conditioning seed cotton for ginning comprising, a vertically elongated drying tower casing having an inlet adjacent the top for cotton-conveying heated drying air and cotton conveyed by the drying air and having an air and cotton outlet adjacent the bottom means for heating the drying air, a plurality of vertically spaced horizontal metallic shelves fixed in the casing, said shelves from the uppermost to the lowermost commencing alternately from opposite sides of the casing and each terminating short of the side opposite its commencement thereby defining a continuous restricted zig-zag flow path from the upper end to the lower end of the casing communicating respectively with said inlet and said outlet, the heated drying air and cotton conveyed thereby being admitted to the upper end of said flow path at said inlet to be circulated through said flow path for evaporating moisture from the cotton in the dryer while the drying air impels the cotton along the flow path, means for supplying heat to said metallic shelves independent of said cotton conveying heated drying air coursing through the drier for heating the surfaces of the shelves substantially throughout their extent to diminish the loss of heat energy from the heated drying air as it courses from top to bottom through said flow path and to aid drying of the cotton, moisture regulating means including means for processing a portion of the seed cotton being discharged from said cotton outlet to produce signals indicative of the moisture content thereof, and means for varying the heating of the heated drying air responsive to said signals to automatically maintain a predetermined moisture content of the seed cotton being discharged from said outlet.

22. Seed cotton drying apparatus for conditioning seed cotton for ginning comprising, a vertically elongated drying tower casing having an inlet adjacent the top for cotton-conveying heated drying air and cotton conveyed by the drying air and having an air and cotton outlet adjacent the bottom means for heating the drying air, a plurality of vertically spaced horizontal metallic shelves fixed in the casing, said shelves from the uppermost to the lowermost commencing alternately from opposite sides of the casing and each terminating short of the side opposite its commencement thereby defining a continuous restricted zig-zag flow path from the upper end to the lower end of the casing communicating respectively with said inlet and said outlet, the heated drying air and cotton conveyed thereby being admitted to the upper end of said flow path at said inlet to be circulated through said flow path for evaporating moisture from the cotton in the dryer while the drying air impels the cotton along the flow path, means for supplying heat to said metallic shelves independent of said cotton conveying heated drying air coursing through the drier for heating the surfaces of the shelves substantially throughout their extent to diminish the loss of heat energy from the heated drying air as it courses from top to bottom through said flow path and to aid drying of the cotton, means for withdrawing a sample of the seed cotton being conveyed from said cotton outlet, separating the withdrawn cotton from conveying air, and forming a seed cotton batt therefrom, means for measuring the electrical resistance properties of the cotton batt to produce signals indicative of the moisture content of the cotton and varying the heating of the heated drying air responsive to said signals to automatically maintain a predetermined mositure content of the seed cotton being discharged from said cotton outlet.

23. Seed cotton drying apparatus for conditioning seed cotton for ginning comprising, a vertically elongated drying tower casing having an inlet adjacent the top for heated drying air and cotton conveyed by the drying air and an air and cotton outlet adjacent the bottom, means for heating the drying air a plurality of vertically spaced horizontal metallic shelves fixed in the casing having hollow interiors defining an air heating chamber extending throughout each shelf, said shelves from the uppermost to the lowermost commencing alternately from opposite sides of the casing and each terminating short of the side opposite its commencement, thereby defining a continuous restricted zig-zag flow path from the upper end to the lower end of the casing communicating with said inlet and outlet, the heated drying air and cotton being admitted to the upper end of said path at said inlet, means for circulating heated drying air through said flow path from said inlet to said outlet to evaporate moisture from the cotton in the dryer and impel the cotton along said flow path, a shelf heating source for supplying heated air to the shelf interiors, and means interconnecting the hollow interiors of said shelves with the shelf heating source of heated air in a shelf heating circuit for internally heating the shelves to diminish loss of heat energy from the heated drying air as it courses from top to bottom through zig-zag path and aid drying of the cotton, moisture regulating means including means for processing a portion of the seed cotton being discharged from said cotton outlet to produce signals indicative of the moisture content thereof, and means for varying the heating of the heated drying air responsive to said signals to automatically maintain a predetermined moisture content of the seed cotton being dischared from said outlet.

24. Seed cotton drying apparatus as defined in claim 23, including means for withdrawing a sample of the seed cotton being conveyed from said cotton outlet, separating the withdrawn cotton from conveying air, and forming a seed cotton batt therefrom, means for measuring the electrical resistance properties of the cotton batt to produce signals indicative of the moisture content of the cotton and varying the heating of the heated drying air responsive to said signals to automatically maintain a predetermined moisture content of the seed cotton being discharged from said cotton outlet.

25. The method of conditioning seed cotton for ginning which comprises impelling the cotton along shelf surfaces defining a restricted zig-zag path in a tower dryer from a higher to a lower level by means of a high velocity stream of heated air flowing along said path, discharging the cotton and impelling air from the dryer and separating cotton from the impelling air, forming the separated cotton into a batt and electrically measuring the moisture content thereof, and controlling the heating of the impelling heated air supplied to the dryer responsive to the electrical moisture measurements to maintain a predetermined moisture content of the cotton being discharged from the dryer.

26. The method of conditioning seed cotton defined in claim 25, in which the velocity of the impelling heated air is reduced in successive predetermined stages along said zig-zag path in the dryer by successively increasing shelf spacing therein.

27. The method of conditioning seed cotton defined in claim 25, in which heated air is supplied from externally of the dryer to interiors of the shelves defining said shelf surfaces to heat the shelf surfaces and facilitate drying of the cotton along said path.

28. The method of conditioning seed cotton for ginning which comprises impelling the cotton along shelf surfaces defining a restricted zig-zag path in a tower dryer from a higher to a lower level by means of a high velocity stream of heated air flowing along said path, discharging the cotton and impelling air from the dryer and separating cotton from the impelling air, recycling at least some of the separated impelling heated air through the dryer, reducing the velocity of the impelling heated air in the dryer in successive stages along said zig-zag path by successively increasing shelf spacing therein, and supplying shelf heating air from a heating source to interiors of the shelves defining said shelf surfaces to heat the shelf surfaces and facilitate cotton drying.

* * * * *